US006430744B1

(12) United States Patent
Redman et al.

(10) Patent No.: US 6,430,744 B1
(45) **Date of Patent: *Aug. 13, 2002**

(54) FOREARM CHAPS

(76) Inventors: Rhonda S. Redman; Ricky V. Redman, both of 98-64th Way, Fridley, MN (US) 55432

( * ) Notice: Subject to any disclaimer, the term of this patent is extended or adjusted under 35 U.S.C. 154(b) by 0 days.

This patent is subject to a terminal disclaimer.

(21) Appl. No.: 09/519,899

(22) Filed: Mar. 6, 2000

(51) Int. Cl.[7] ..... A41D 13/08; A61F 9/00

(52) U.S. Cl. ..... 2/16; 2/161; 2/162

(58) Field of Search ..... 2/16, 161, 162, 2/159, 161.6, 170, 59, 125, 126, 163, 269, 270

(56) References Cited

U.S. PATENT DOCUMENTS

| | | | | |
|---|---|---|---|---|
| 363,829 A | | 5/1887 | Jennings | |
| 622,688 A | | 4/1899 | Horn | |
| 906,856 A | | 12/1908 | Bernard | |
| 2,904,792 A | | 9/1959 | Elliott | 2/16 |
| 3,000,378 A | | 9/1961 | Zieman | 128/165 |
| 3,559,640 A | | 2/1971 | Beckett | 128/94 |
| 4,011,596 A | | 3/1977 | Chang | 2/16 |
| 4,473,614 A | | 9/1984 | Hockmeyer | 428/248 |
| D290,766 S | | 7/1987 | Pierce, Jr. | D29/20 |
| 4,764,319 A | | 8/1988 | Finnieston et al. | 128/87 |
| D299,562 S | | 1/1989 | Lee | D29/20 |
| D300,676 S | | 4/1989 | Pierce, Jr. | D29/20 |
| 4,868,927 A | | 9/1989 | Bourdeau et al. | 2/161 |
| 4,873,968 A | | 10/1989 | Finnieston et al. | 128/87 |
| 4,967,419 A | | 11/1990 | Elliott | 2/16 |
| 5,070,541 A | | 12/1991 | Goss | 2/16 |
| 5,073,988 A | | 12/1991 | Lewis, Jr. et al. | 2/162 |
| 5,402,536 A | | 4/1995 | Matthews | 2/16 |
| 5,526,531 A | | 6/1996 | Olson et al. | 2/16 |
| 5,878,435 A | * | 3/1999 | Kast et al. | 2/16 |

* cited by examiner

*Primary Examiner*—Amy Vanatta
*Assistant Examiner*—Robert H. Muromoto, Jr.
(74) *Attorney, Agent, or Firm*—Kinney & Lange, P.A.

(57) ABSTRACT

A forearm chaps having a sleeve with a primary opening at one end and at another end a discrete finger opening and a discrete thumb opening. The forearm chaps also includes a longitudinal opening disposed along the sleeve. The longitudinal opening extends from a point directly adjacent ajuncture of the carpal bones and the radius of a hand of the wearer and extends rearwardly along an forward side of the forearm approximately to the primary opening at the end of the sleeve. A closure mechanism is included that extends from the juncture of the sleeve that overlies the carpal bones and radius and the closure mechanism extends rearwardly to the end of the sleeve for bringing the edges of the sleeve together to conform the sleeve to the forearm of the wearer.

17 Claims, 5 Drawing Sheets

FOREARM CHAPS

BACKGROUND OF THE INVENTION

The present invention relates to forearm chaps, and in particular, it relates to a forearm chaps that is also visually appealing.

Coverings for the hand and forearm or for the forearm or hand individually are well known. There are numerous reasons why such hand and forearm protectors are used. Some of these reasons relate to protection in athletics, for example, linemen wear forearm protectors in football or in-line skaters wear hand and wrist guards. Hand and forearm protectors also are used for medical reasons as restraining devices such as to protect a sprained wrist. Additional, examples of hand and forearm protectors are found in the following U.S. patents.

| Inventor | U.S. Pat. No. |
|---|---|
| Jennings | 363,829 |
| Horn | 622,688 |
| Bernard | 906,856 |
| Elliot | 2,904,792 |
| Zieman | 3,000,378 |
| Beckett | 3,559,640 |
| Chang | 4,011,596 |
| Hockmeyer | 4,473,614 |
| Finnieston et al. | 4,765,319 |
| Bourdeau et al. | 4,868,927 |
| Finnieston et al. | 4,873,968 |
| Elliot | 4,967,419 |
| Goss | 5,070,541 |
| Lewis, Jr. et al. | 5,073,988 |
| Matthews | 5,402,536 |
| Olson et al. | 5,526,531 |
| Pierce, Jr. | Des. 290,766 |
| Lee | Des. 299,562 |
| Pierce, Jr. | Des. 330,676 |

BRIEF SUMMARY OF THE INVENTION

The present invention includes a forearm chaps having a sleeve. The sleeve has a primary opening at one end and at another end a discrete finger opening and a discrete thumb opening. A longitudinal opening is disposed along the sleeve and extends from a point directly proximal ajuncture of the carpal bones and the radius of a hand of the wearer rearwardly along a foreword side of the forearm to approximately the end of the sleeve. A closure mechanism, preferably a zipper, extends from the point of the sleeve overlying the juncture of the carpal bones and radius rearwardly to the end of the sleeve for bringing the edges of the sleeve together to conform the sleeve to the forearm of the wearer.

DETAILED DESCRIPTION OF THE PREFERRED EMBODIMENTS

Figure 1:
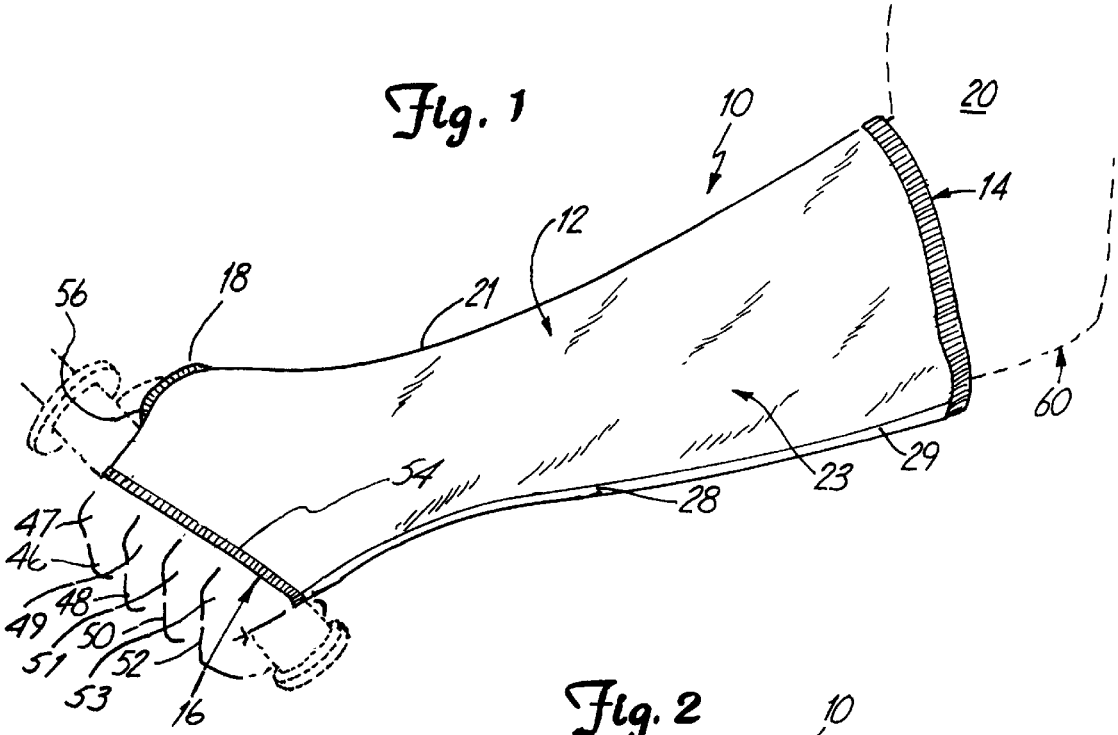
FIG. 1 is a perspective view of the forearm chaps of the present invention.
Figure 2:
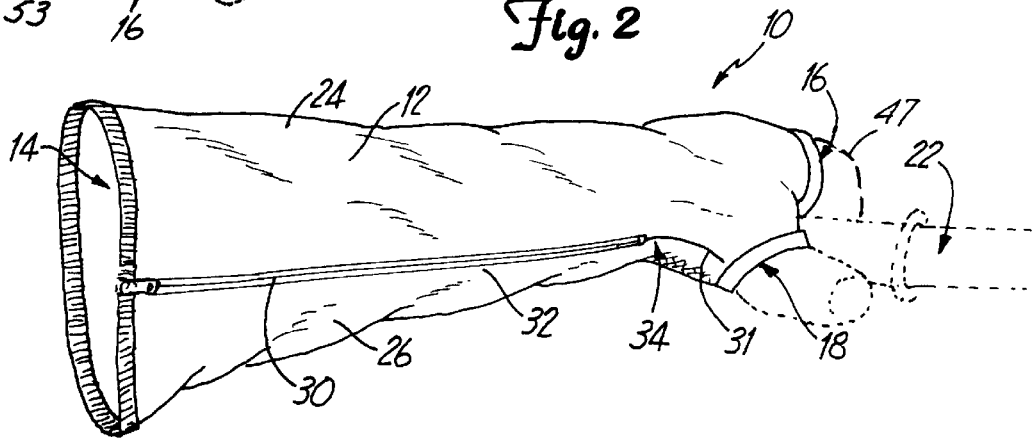
FIG. 2 is a perspective view from a different angle of the forearm chaps.

The forearm chaps of the present invention is generally illustrated at 10 in FIGS. 1–9. The forearm chaps 10 is used to cover and protect a proximal portion of a hand 21 and an entire forearm 23 of a motorcycle driver (not shown) when riding and gripping handlebars 22 of a motorcycle as illustrated in FIG. 2. The forearm chaps 10 aids in preventing the motorcycle driver (not shown) from getting chilled by preventing the wrist area from being exposed when there is a gap between the motorcycle driver's jacket and glove, especially when the arm is extended when gripping the handlebars. The hand and forearm protector 10 is also designed to be worn as a decorative piece of clothing and as such its use is not limited to driving motorcycles.

Figure 3:
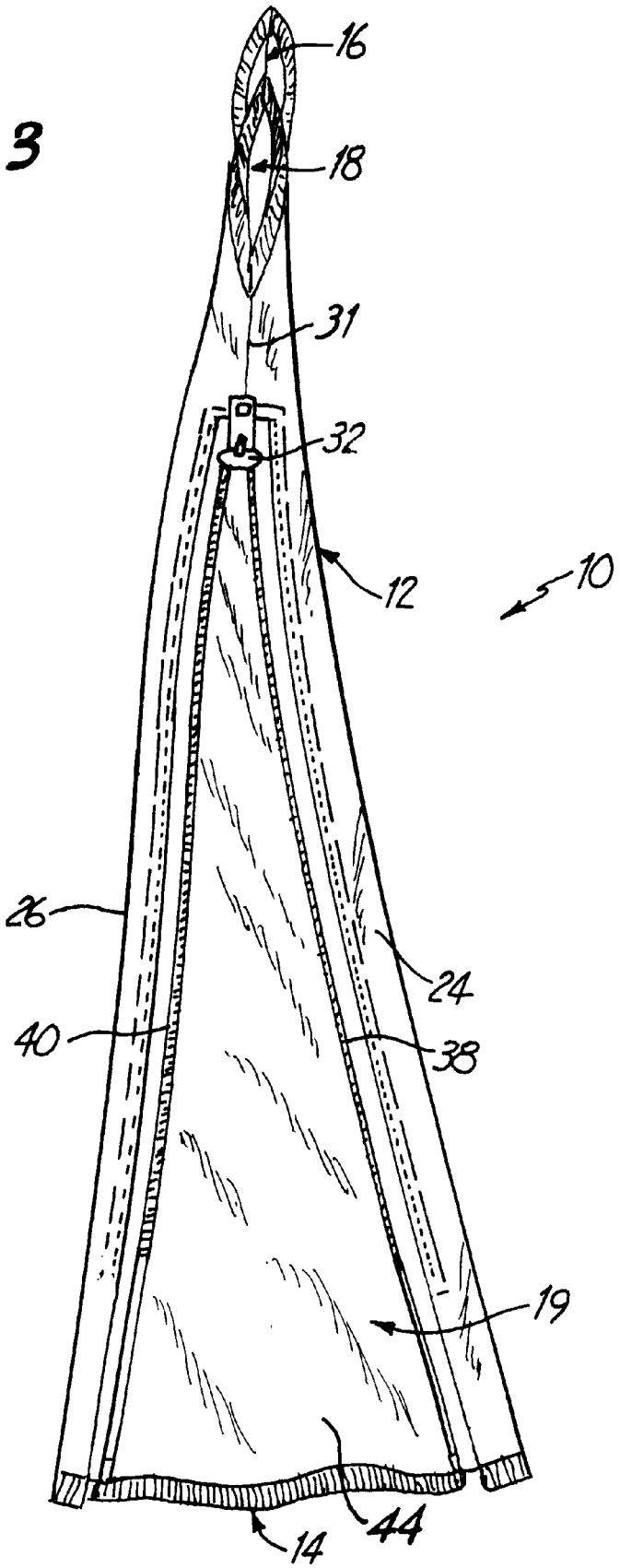
FIG. 3 is a side view ofthe forearm chaps with a zipper in an open position.
Figure 4:
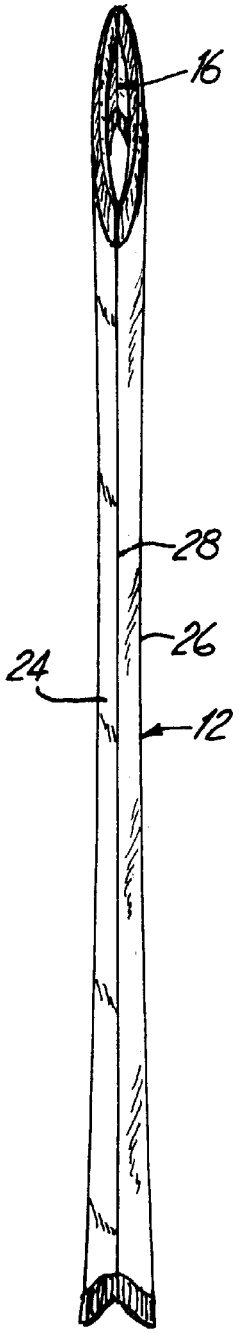
FIG. 4 is a left side plan view of the forearm chaps.
Figure 5:
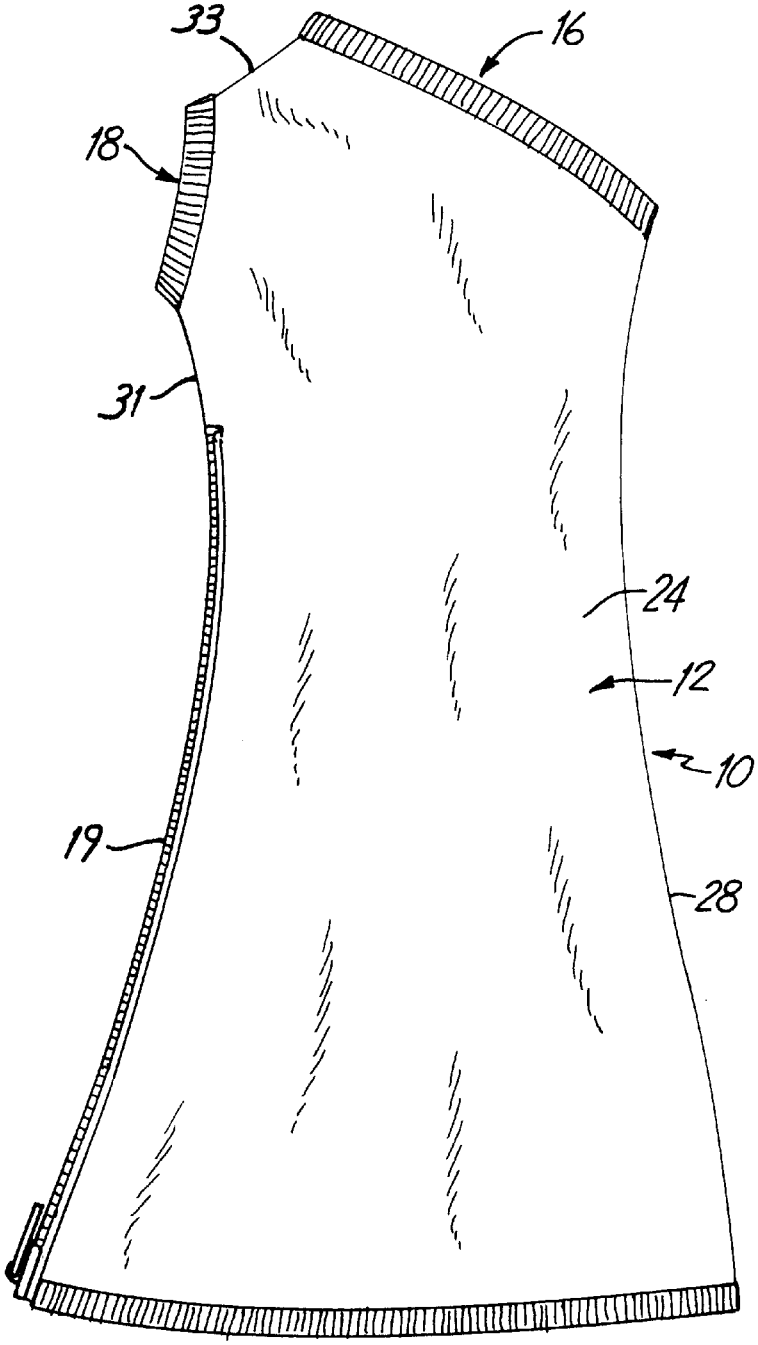
FIG. 5 is a top plan view of the forearm chaps.
Figure 6:
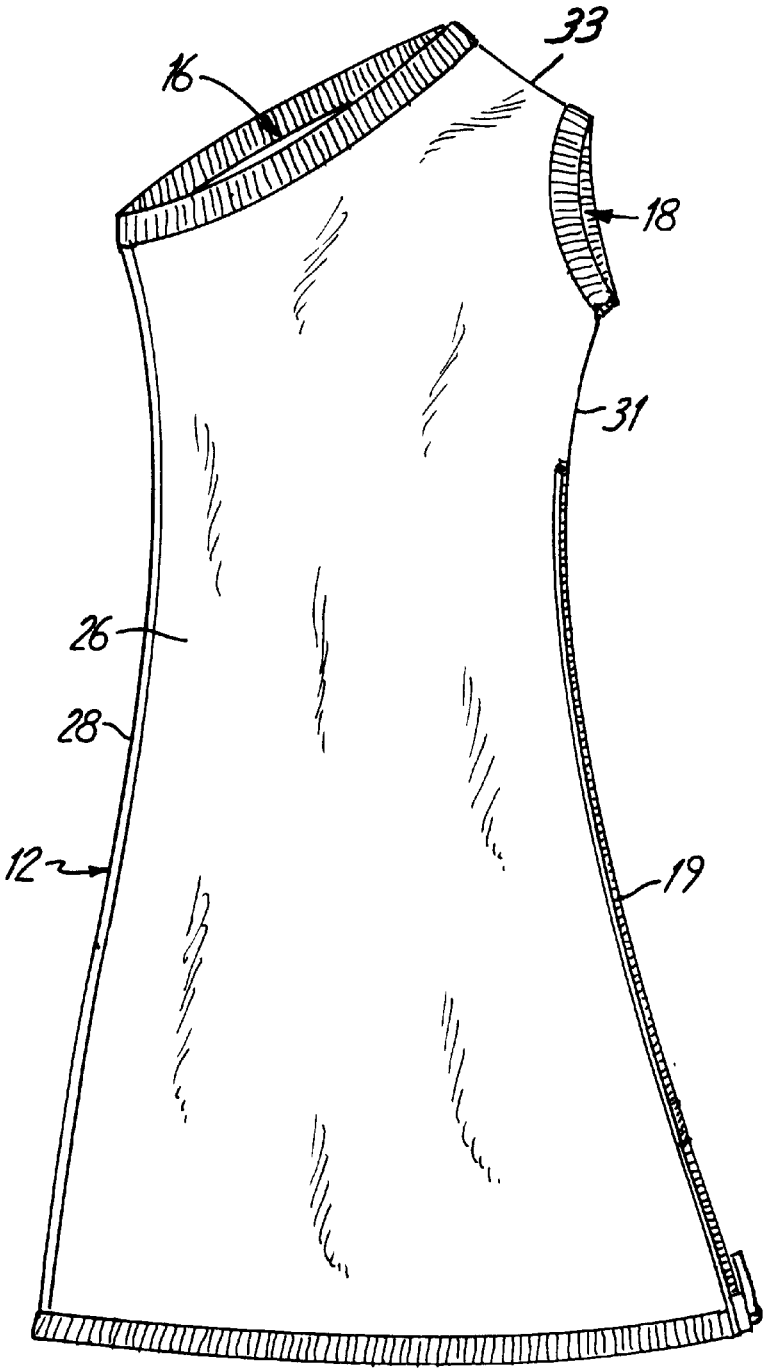
FIG. 6 is a bottom plan view of the forearm chaps.
Figure 7:
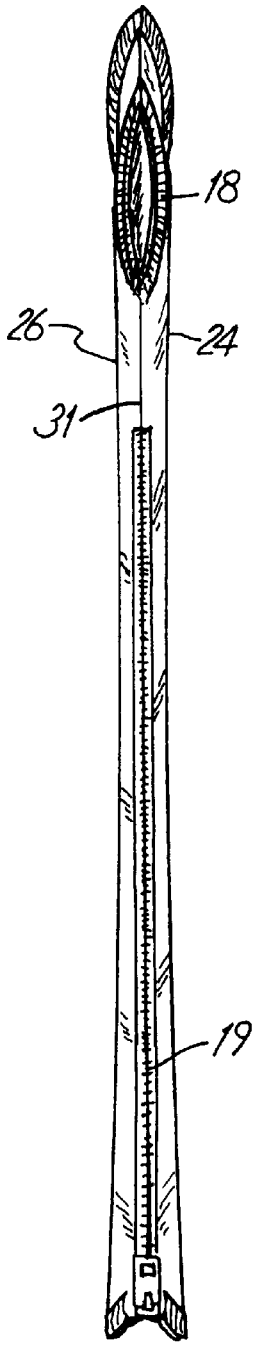
FIG. 7 is a right side plan view of the forearm chaps.

As best illustrated in FIGS. 1, 2 and 3 the forearm chaps 10 includes a sleeve portion 12 having at one end a forearm opening 14 and at another end a discrete digit opening 16 and a discrete thumb opening 18. The thumb opening 18 is an opening that is discrete from and separate from the digit opening 16. The openings 16 and 18 are separated by a section 33 of the sleeve 12 as illustrated in FIGS. 5 and 6. The sleeve also includes a longitudinal opening 19 that overlies a forward forearm. By forward forearm is meant that portion of the forearm that faces forward when the arms are left to hang naturally and loosely along side the body.

The sleeve 12 of the forearm chaps 10 is made of a flexible continuous piece of fabric sewn to create a cylindrical-type structure into which the hand 21 is inserted along with the entire forearm 23 of the wearer 20. The sleeve 12 may be made of any suitable fabric that is pliable, wear resistant and suitable for use outdoors. A preferred material is leather although other materials suitable or popular for outdoor use are included within the scope of the present invention.

Figure 8:
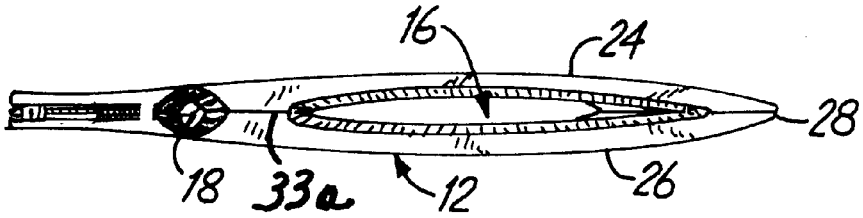
FIG. 8 is a front plan view.
Figure 9:
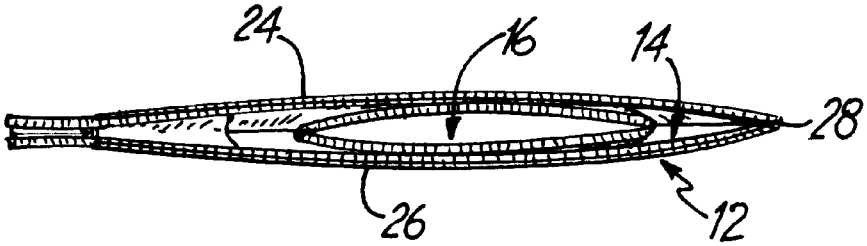
FIG. 9 is a rear plan view.

For purposes of description in this application, the surface of the sleeve 12 is divided into an outer surface segment 24 and an inner surface segment 26 joined at a rearward surface segment 28. The outer surface segment 24 faces away from the body when the arms are left to hang naturally and loosely along side the body while the inner surface segment 26 faces the body. Similarly, the rearward surface segment 28 covers a rearward portion of the forearm 23. The sleeve 12 has a continuous uninterrupted surface through the outer surface segment 24, the inner surface segment 26 and the rearward surface segment 28 as illustrated in the FIGS. 1, 5 and 6. The sleeve 12 extends away from the hand, to approximately 1 to 1½ inches from the wearers elbow 60, as best illustrated in FIG. 1. In one preferred embodiment, the sleeve 12 is made of two distinct pieces of leather, joined by sewing along a line 29 that extends along the entire length of the sleeve as best illustrated in FIG. 1, and sewn along a line 33*a* between the thumb opening 18 and digit opening 16, as best illustrated in FIG. 8, and sewn along a line 31 that extends from the thumb opening 18 to the longitudinal opening 19 as best illustrated in FIG. 3.

Referring to FIGS. 2 and 3, in one preferred embodiment a closure mechanism 30 is provided to open and close the opening 19. The closure mechanism 30 is positioned to start at a point 34 on the sleeve 12 that is directly adjacent rearwardly of the ball of the thumb which is sometimes referred to as to thenar muscle. The closure mechanism is preferably a zipper 32, although one skilled in the art will also appreciate that the closure mechanism could include, but is not limited to, a button closure, a lacing mechanism, or a velcro closure. In relation to bone structure, this position may also be defined as a juncture of the carpal bones and radius. The sleeve 12 is sewn along the line 31 such that the sleeve 12 conforms in a snug fashion to the ball of the thumb.

The longitudinal opening 19 extends from this position to the end ofthe sleeve 12 at the forearm opening 14 to permit inserting the hand ofthe wearer into the forward portion of the sleeve 12 and once inserted, the zipper 32 is closed to conform the sleeve 12 to the wearer's forearm 23. The zipper 32 when in a closed position brings an upper edge 38 of the segment 24 and a lower edge 40 of the segment 26 together to conform the sleeve 12 to the forearm 23 of the wearer 20 in a form-fitting fashion as best illustrated in FIGS. 1, 2 and 3.

To insert the hand 21 and forearm 23 into the forearm chaps 10, the zipper 32 is positioned in an open position as illustrated in FIG. 3 which permits the opening 19 to widen. An inner flap section 44 triangular in configuration is attached along one edge to an inner surface of the segment 26 and at another edge to an inner surface of the segment 24 as illustrated in FIG. 3. The flap 44 is disposed such that its apex is proximate the ball of the thumb while its base is disposed proximate the forearm opening 14. The flap section 44 protects the user's forearm from being pinched by the zipper 32 when the slide of the zipper 32 is moved. One skilled in the art will appreciate that decorative indicia (not shown) may be placed on the flap section 44 which are visually appealing when the zipper 32 is in the open position. The wearer of the forearm chaps 10 may desire to wear the forearm chaps 10 with the zipper 32 open thereby exposing the flap section 44 over a thick jacket to keep the wearer's forearms warm especially when riding a motorcycle when the wind tends to create a gap between the jacket and the glove of the wearer.

Referring to FIG. 1, the digit opening 16 is sufficiently wide for all four fingers 46, 48, 50 and 52 to extend therethrough. The opening 16 includes an edge 54 which encircles all four fingers as a unit. The sleeve 12 extends up to each fingers' first set ofjoints or knuckles 47, 49, 51 and 53. The first set ofjoints of the fingers are defined as those joints or knuckles that are formed at the articulation ofthe metacarpal bone and the phalange of each finger. The sleeve 12 does not extend over the joints or knuckles 47, 49, 51 and 53 thereby exposing those knuckles as best illustrated in FIG. 1 wherein the edge 54 lies directly adjacent to the exposed knuckles 47, 49, 51 and 53. Preferably, the sleeve 12 is positioned approximately one inch below the exposed knuckles 47, 49, 51 and 53, thereby allowing greater dexterity of the fingers. The design of the forearm chaps 10 allows the wearer of the forearm chaps 10 the ability to keep the wearer's hands covered while working in the cold because of the worker's dexterity is not inhibited. By way of example, if gloves are worn the entire hand must be exposed to obtain more dexterity in the fingers by the removing the glove.

Similarly, the thumb opening 18 has an edge 56 that is disposed to extend the sleeve 12 to a position such that the first joint or knuckle of the thumb that is formed by an articulation of the metacarpal bone and the phalange is covered. This firstjoint is sometimes referred to as the main or large knuckle of the thumb. Preferably, the edge 56 of the thumb opening 18 extends up to but does not cover the phalanges joint of the thumb. The phalanges joint is sometimes referred to as the small knuckle before the thumbnail. This joint is left exposed.

It will be appreciated that the position of the zipper 32, that is along an inner section of the forearm, permits the application of decorative designs along the outer segment 24, the rearward segment 28 and the inner segment 26. Indicia such as designs and other decorative features may be placed on the sleeve without interference or interruption by closure or fastening mechanisms that are found in prior art forearm protectors. The tight fit or conformance to the proximal portion of the hand exposing all of the knuckles of the fingers while covering the first joint of the thumb is very visually pleasing.

Although the present invention has been described with reference to preferred embodiments, workers skilled in the art will recognize that changes may be made in form and detail without departing from the spirit and scope of the invention.

What is claimed is:

1. A forearm chaps comprising:

a sleeve for overlying a forearm and a proximal hand portion of a wearer;

a primary opening at one end of the sleeve;

a single discrete digit opening at another end of the sleeve wherein the wearer's fingers extend therethrough, wherein the sleeve extends to a point adjacent a first set of joints of a wearer's fingers, leaving the joints exposed;

a discrete thumb opening disposed at the end of the sleeve proximate to the discrete digit opening;

a longitudinal opening along the sleeve extending adjacent from a point that overlies a juncture of the carpal bones and the radius and extending rearwardly towards the primary opening to proximately the end of the sleeve; and a closure mechanism for closing the longitudinal opening to conform the sleeve to the forearm of the wearer, the closure being disposed to overlie a forward side of the forearm.

2. The chaps of claim 1 wherein the closure mechanism is a zipper that extends along the entire length of the longitudinal opening.

3. The chaps of claim 1 and further including a protective flap that extends between edges of the opening protecting the wearer from being pinched by the zipper.

4. The chaps of claim 1 wherein the sleeve extends to approximately 1 to 1½ inches from an elbow of the wearer.

5. The chaps of claim 1 wherein the sleeve extends beyond a first joint of the thumb, and adjacent to ajoint of the phalanges of the thumb but leaving the phalanges joint of the thumb exposed.

6. The chaps of claim 1 wherein the sleeve includes decorative indicia on an uninterrupted surface.

7. A forearm chaps comprising:

a sleeve for overlying a forearm and a proximal hand portion of a wearer;

a primary opening at one end of the sleeve;

a discrete digit opening disposed at another end of the sleeve;

a discrete thumb opening disposed at the end of the sleeve proximate to the discrete digit opening, wherein the wearer's thumb extends therethrough, wherein the sleeve extends adjacent to a joint of the phalanges of the thumb, leaving the joint of the phalanges exposed;

a longitudinal opening along the sleeve extending adjacent from a point that overlies a juncture of the carpal bones and the radius and extending rearwardly towards the primary opening to proximately the end of the sleeve; and a closure mechanism for closing the longitudinal opening to conform the sleeve to the forearm of the wearer.

8. The chaps of claim 7 wherein the closure mechanism is a zipper that extends along the entire length of the longitudinal opening.

9. The chaps of claim 7 and further including a protective flap that extends between edges ofthe opening protecting the wearer from being pinched by the zipper.

10. The chaps of claim 7 wherein the sleeve extends to approximately 1 to 1½ inches from an elbow of the wearer.

11. The chaps of claim 7 wherein the sleeve extends to a point adjacent a first set of joints of the wearer's fingers, leaving the joints exposed.

12. The chaps of claim 7 wherein the sleeve includes decorative indicia on an uninterrupted surface.

13. A forearm chaps comprising:

a sleeve for overlying a forearm and a proximal hand portion of a wearer;

a primary opening at one end of the sleeve;

a discrete digit opening at another end of the sleeve wherein the wearer's fingers extend therethrough, wherein the sleeve extends to a point adjacent a first set of joints of a wearer's finger, leaving the joints exposed;

a discrete thumb opening disposed at the end of the sleeve proximate to the discrete digit opening, wherein the wearer's thumb extends therethrough, wherein the sleeve extends beyond a first joint of the thumb and adjacent to a joint of the phalanges of the thumb, leaving the joint of the phalanges exposed;

a longitudinal opening along the sleeve extending adjacent from a point that overlies a juncture of the carpal bones and the radius and extending rearwardly towards the primary opening to proximately the end of the sleeve; and a closure mechanism for closing the longitudinal opening to conform the sleeve to the forearm of the wearer.

14. The chaps of claim 13 wherein the closure mechanism is a zipper that extends along the entire length of the longitudinal opening.

15. The chaps of claim 13 and further including a protective flap that extends between edges ofthe opening protecting the wearer from being pinched by the zipper.

16. The chaps of claim 13 wherein the sleeve extends to approximately 1 to 1½ inches from an elbow of the wearer.

17. The chaps of claim 13 wherein the sleeve includes decorative indicia on an uninterrupted surface.

* * * * *